US007442896B2

(12) United States Patent
Ehrat et al.

(10) Patent No.: US 7,442,896 B2
(45) Date of Patent: Oct. 28, 2008

(54) METHOD FOR PROCESSING MAIL

(75) Inventors: Josef Ehrat, Munich (DE); Werner Halder, Waldburg (DE); Karl-Josef Kurtz, Brunnthal (DE); Heinz Pechtl, Kuemmersbruck (DE); Norbert Weber, Puchheim (DE)

(73) Assignee: Deutsche Post AG, Bonn (DE)

( * ) Notice: Subject to any disclaimer, the term of this patent is extended or adjusted under 35 U.S.C. 154(b) by 364 days.

(21) Appl. No.: 11/299,256

(22) Filed: Dec. 9, 2005

(65) Prior Publication Data

US 2006/0180520 A1 Aug. 17, 2006

Related U.S. Application Data

(63) Continuation of application No. PCT/DE04/01162, filed on Jun. 7, 2004.

(30) Foreign Application Priority Data

Jun. 10, 2003 (DE) ..... 103 26 495

(51) Int. Cl.
*B07C 5/00* (2006.01)

(52) U.S. Cl. ..... 209/584; 209/900; 209/903

(58) Field of Classification Search ..... 209/583, 209/854, 900, 903; 700/223–227
See application file for complete search history.

(56) References Cited

U.S. PATENT DOCUMENTS

| | | | | |
|---|---|---|---|---|
| 4,136,780 | A | 1/1979 | Hunter et al. | 209/539 |
| 4,835,711 | A | 5/1989 | Hutchins et al. | 364/513 |
| 5,271,710 | A | 12/1993 | Decharran et al. | 414/798.9 |
| 5,346,351 | A * | 9/1994 | Priolo et al. | 414/277 |
| 5,363,310 | A * | 11/1994 | Haj-Ali-Ahmadi et al. | 700/216 |
| 5,546,475 | A | 8/1996 | Bolle et al. | 382/190 |
| 5,667,078 | A * | 9/1997 | Walach | 209/584 |
| 5,906,468 | A * | 5/1999 | Vander Syde et al. | 414/403 |

(Continued)

FOREIGN PATENT DOCUMENTS

| | | |
|---|---|---|
| DE | 1 054 015 | 3/1959 |

(Continued)

OTHER PUBLICATIONS

International Search Report in PCT/DE2004/001162 dated Sep. 10, 2004.

(Continued)

*Primary Examiner*—Joseph C Rodriguez
(74) *Attorney, Agent, or Firm*—Marshall, Gerstein & Borun LLP

(57) ABSTRACT

A method for processing mail, wherein a plurality of mailing items inserted into insertion places are collected and subsequently transported in a container to postal centers where they are sorted in sorting devices according to postal categories. The invention is characterized in that the mail is placed in transport containers which are transported to unloading areas in postal centers. When the transport container is filled and/or during the transportation of the container to the postal centers, random partial pre-sorting of mail takes place according to postal categories so that, when, the mail is removed from the containers at the unloading areas, it is in the form of piles formed by the predetermined pre-sorting method and sorted according to the postal categories, whereupon it is guided to subsequent processing stations according to said postal categories.

17 Claims, 4 Drawing Sheets

U.S. PATENT DOCUMENTS

| | | | | |
|---|---|---|---|---|
| 6,126,017 | A | 10/2000 | Hours | 209/698 |
| 6,234,737 | B1 * | 5/2001 | Young et al. | 414/277 |
| 6,501,041 | B1 * | 12/2002 | Burns et al. | 209/584 |
| 6,561,339 | B1 * | 5/2003 | Olson et al. | 198/349 |
| 7,006,891 | B2 * | 2/2006 | Roth et al. | 700/217 |
| 7,081,595 | B1 * | 7/2006 | Brandt et al. | 209/584 |
| 7,304,260 | B2 * | 12/2007 | Boller et al. | 209/584 |

FOREIGN PATENT DOCUMENTS

| | | | |
|---|---|---|---|
| DE | 74 22 700 | | 4/1975 |
| DE | 37 88 596 | T2 | 4/1994 |
| DE | 695 18 947 | T2 | 3/2001 |
| DE | 201 21 614 | U1 | 3/2003 |
| EP | 251 441 | B1 | 1/1988 |
| EP | 436 521 | B1 | 7/1991 |
| EP | 685 814 | B1 | 12/1995 |
| EP | 1 072 328 | A2 | 1/2001 |
| FR | 2 637 823 | | 4/1990 |
| FR | 2 815 558 | | 4/2002 |
| WO | WO 03/035527 | A1 | 5/2003 |

OTHER PUBLICATIONS

International Preliminary Examination Report in PCT/DE2004/001162 dated May 9, 2005.

* cited by examiner

METHOD FOR PROCESSING MAIL

CROSS-REFERENCE TO RELATED APPLICATION

This is a continuation of international application PCT/DE2004/001162 filed Jun. 7, 2004, the entire disclosure of which is hereby incorporated by reference.

BACKGROUND OF THE INVENTION

1. Field of the Invention

The invention relates to a method for processing mailpieces that have been dropped into mail drop boxes, whereby a plurality of mailpieces are collected and then transported in transportation containers to postal centers and are sorted in the postal centers by means of sorting devices according to postal categories.

2. Description of Related Technology

Methods of this generic type are being used by postal service providers worldwide for millions of letters daily.

One prior-art method of this type is known from EP 1 072 328 A2. This method involves sorting mailpieces during their transportation on conveyor belts according to postal categories. During the transportation of the mailpieces on the conveyor belt, the weight and the dimensions of the mailpieces are ascertained. Subsequently, on the basis of the determined weight and the determined dimensions, the mailpieces are classified in postal categories and systematically ejected from the area of the conveyor belt.

FR 2 637 823 relates to a device for automatically sorting envelopes with which envelopes of various formats are delivered in a container, aligned in a special manner, and are then removed from the container in groups and fed to the sorting device. After a singulation step, the size of the envelopes is determined by means of specially arranged light barriers and the envelopes are diverted into different containers on the basis of their size.

U.S. Pat. No. 4,136,780 describes a singulation and sorting system with which the mailpieces are first placed into an input hopper and then separated by an inclined conveyor. Via a controllable receiving station, the mailpieces then reach one of several singulation sections which are followed by a device in which photocells ascertain the dimensions of the mailpieces. Subsequently, the mailpieces are diverted and stacked according to their dimensions.

U.S. Pat. No. 6,126,017 discloses a device for sorting mailpieces with which the mailpieces, sorted according to address, are diverted into buffer receptacles in which the mailpieces become arranged in stacks. Once a buffer receptacle is filled, the mailpieces are emptied in an output receptacle.

Moreover, EP 0 436 521 A2 describes a method and a device for identifying mailpieces in order to mark "zip-code" segments in stacks of mailpieces. Here, stacks of mailpieces are placed into a hopper and then singulated. A reader then ascertains the "zip code" and the mailpieces are provided with a first identification mark at a certain position, which is changed when the "zip code" is changed, and they are likewise provided with an identification mark whose position is changed every time the first three digits of the "zip code" changes. Subsequently, the mailpieces are stacked.

With the known methods of this type, the contents of the transportation containers are tipped out, immediately placed onto conveyor belts and ejected on the conveyor belts from a predefined conveying sequence according to postal categories.

Methods are likewise known with which mailers of mailpieces sort the mailpieces according to sorting criteria specified by the particular postal service provider and then mail them according to this sorting. The mail that has been presorted in this manner is subsequently taken directly to an appropriate processing station according to the complete presorting that was systematically undertaken by the mailer.

Moreover, in the state of the art, several non-generic product recognition systems are known. The prior-art product recognition systems allow the recognition of objects preferably by means of computer-aided optical scanning devices.

A known non-generic product recognition system is described in European patent EP 0 685 814 B1 and in its German counterpart DE 695 18 947 T2. This known product recognition system allows the identification, classification, evaluation and verification of objects. By using computer systems that make evaluations on the basis of target object images, it is possible to achieve teachable object recognition and consequently to depict numerous objects. This known non-generic method is especially well-suited for distinguishing between various kinds of fruit.

Moreover, numerous automatic control systems for robots are known in the state of the art.

A non-generic automatic control system with a robot-controlled manipulation means is known from EP 0 251 441 B1 and in its German counterpart DE 37 88 596 T2. This known automatic control system allows the guidance of a manipulation means as a function of determined information. Its use in laboratory systems is explained here by way of an application example for this automatic control system.

GENERAL DESCRIPTION OF THE INVENTION

The invention is provides a method that is suited for bulk sorting of mailpieces according to postal categories at a high processing speed in bulk operations in postal centers with minimal processing effort.

According to the invention, a processing method is carried out in such a way that the mailpieces are filled into the transportation containers, the transportation containers filled with the mailpieces are transported to unloading stations in the postal centers, during the filling of the transportation containers and/or during transport of the transportation containers to the postal center, a partial presorting of the mailpieces according to postal categories occurs, and subsequently, at the unloading stations, the mailpieces are removed in stacks from the transportation containers, utilizing the presorting according to postal categories, and the mailpieces are conveyed to subsequent processing stations as a function of the postal category.

The invention utilizes the surprising realization that an essentially coincidence-based presorting occurs during the filling and/or the transportation of mailpieces, so as to achieve a systematic processing of the mailpieces, in that the mailpieces are removed from the transportation containers according to the resultant presorting and are subsequently brought to the processing stations corresponding to the individual postal categories.

The mail drop boxes can be designed in many different ways. These can be post office branches, or postal agencies as well as mailboxes or receptacles in the area of customers of a postal service provider.

Previously, it has been assumed in technical circles that mailpieces are dropped into mailboxes completely at random and that they are thoroughly mixed up by the subsequent transport and handling procedures. In spite of handling several million letters every year, so far, no person skilled in the art has become aware of the fact that a presorting occurs through simple handling procedures of the mailpieces, especially their filling into transportation containers and the transport of the preferably box-shaped transportation containers.

Based on the conviction firmly held in technical circles that the mailpieces are unsorted, until now, mailpieces collected in mailboxes have been tipped out directly onto conveyor belts at the postal centers.

According to the invention, the mailpieces are removed from the transportation containers in stacks corresponding to the existing presorting, and the sorting effort is considerably reduced.

The invention can be implemented with various transportation containers. However, it is especially advantageous to use box-shaped transportation containers.

It has been found that a presorting takes place, especially when mailpieces are dropped into box-shaped transportation containers as well as during the transport in box-shaped transportation containers.

The nature of the partial presorting results from the dropping of the mailpieces into the transportation containers, from the structure of the mailpiece, from the transportation conditions and from the relationship between the dimensions of the transportation container and the mailpieces dropped into it.

In particular, partial presorting of the mailpieces results if the mailpieces are transported predominantly while lying flat.

The presorting procedures resulting from the transportation enhance the partial presorting that results during the previous filling of the mailpieces into the transportation containers.

In a preferred embodiment of the invention, at least some of the transportation containers are set up in drop-off places where, at least from one side, the mailpieces can be dropped off in a way that promotes an essentially horizontal position. This embodiment of the method according to the invention allows a faster processing of the mailpieces in the receiving stations.

The fundamentally desirable filling of mailpieces of different postal categories into different transportation containers—including the placement of the mailpieces in the transportation containers in a vertical position that enhances this complete arrangement—can thus be replaced by a much simpler and faster filling of the transportation containers. This is associated with a substantial reduction in time and effort at post offices or other mail receiving stations such as postal agencies.

This handling for some of the transportation containers can be combined at will with a suitable handling of other transportation containers.

A measure that further improves the presorting of the mailpieces according to the invention is characterized in that at least some of the transportation containers are conveyed in transporters means to mailers of mailpieces so that, in the area of the mailer of mailpieces, the mailpieces can be dropped essentially horizontally into the transportation containers.

Such handling is especially well-suited for collecting mailpieces from postal customers. Fundamentally, such a pick-up technique can be carried out for all postal customers, but it is advantageous to implement this pick-up technique especially for those customers who normally mail multiple mailpieces every day.

Mailing methods used so far required the mailers to tediously presort the mailpieces themselves according to postal categories and other sorting criteria or else required the employee of the particular postal service provider who was picking up the mailpieces to place them into the transportation containers arranged according to postal categories. These known methods are associated with the drawback that the mailer or the person picking up the mail has to presort the mailpieces. This calls for a certain amount of time for the mailer or for the person picking up the mail.

In an especially preferred embodiment of the invention, this drawback is avoided in that the mailpieces are placed into the transportation containers in a way that utilizes an essentially coincidentally occurring presorting. This embodiment of the invention takes advantage of the realization that many mailers already stack up the mail by size in a sorted arrangement when they are preparing the mailpieces for pick-up, for example, in order to enhance their overview.

When the transportation containers are filled with the mailpieces that are already presorted in this manner, it is advantageous to first deposit the smaller mailpieces so that the larger mailpieces come to lie on top of the smaller mailpieces.

However, it is likewise advantageous to conversely first deposit the larger mailpieces so that the smaller mailpieces come to lie on top since surprisingly, this, too, results in a partial presorting of the mailpieces.

With other methods of depositing mail, it is also advantageous to drop the mailpieces in a way that enhances such a presorting.

In this manner, a resultant presorting process of the mailpieces according to size is enhanced.

With numerous embodiments of the invention, it has been found that at least some of the largest mailpieces tend to accumulate in the upper part of the postal containers during the processing procedures. This phenomenon is a self-organizing process that enhances the presorting of mail and that has remained unrecognized until now.

Advantageously, other embodiments of the invention also utilize this mechanism of action.

Surprisingly, the partial presorting of the mailpieces that is utilized according to the invention and that arises coincidentally, but statistically reproducibly, also occurs when the mailpieces are dropped into other mail drop boxes such as, for example, mailboxes.

In an especially advantageous embodiment of the invention, this occurs in that at least some of the transportation containers are placed into mailboxes in such a way that mailpieces dropped into the mailboxes end up directly in the transportation containers.

However, it is equally advantageous that at least some of the transportation containers are filled by emptying collecting containers located in mailboxes.

The transportation containers filled with the mailpieces—preferably as a function of their filling level—are transported to additional mail drop boxes or to postal centers.

In a simple and advantageous embodiment of the invention, at least some of the transportation containers are taken directly to the unloading stations. In this manner, the structural requirements for carrying out the method are further reduced.

It is especially advantageous to carry out the invention in such a way that at least some of the transportation containers are taken to the unloading stations by means of a conveyor section. As a result, the feed of the mailpieces to the unloading stations can be adapted to the unloading capacities.

Moreover, it is advantageous for the transportation containers to be conveyed to the unloading means intermittently.

The intermittent feed of the transportation containers is advantageously carried out in such a way that, after a container has been emptied, another container is automatically conveyed to the unloading means. In this manner, the processing speed is further increased.

In an especially preferred embodiment of the invention, the transportation containers are conveyed to the unloading stations in such a way that, at least at times, at least two transportation containers are located in the area of an unloading station.

In this manner, the removal of the mailpieces from the transportation containers can be sped up. In particular, this embodiment of the invention allows the removal of mailpieces from a transportation container during the change-over of another transportation container.

In an especially advantageous embodiment of the invention, stacks of mailpieces of different postal categories are first removed from the transportation containers and, subsequently, mailpieces of one postal category remaining in the transportation containers are tipped out of the transportation container.

These process steps further increase the unloading speed. In particular, this makes it possible to utilize the resulting presorting of the mailpieces for the further simplification of the unloading of the mailpieces. In particular, during the execution of the method involving mailpieces of varying sizes, the smaller-format mailpieces—especially standard format letters—tend to accumulate in the bottom part of the transportation container. In this manner, stacks of mailpieces of different—preferably larger—postal categories can be removed first and subsequently, the mailpieces remaining in the transportation containers after the large mailpieces have been removed can be quickly removed by tipping over the transportation container.

Moreover, it is advantageous that in at least some of the unloading stations, stacks of mailpieces are recognized by at least one optical detection means. In this way, the method can be further sped up and automated.

Additional measures for speeding up and automating the method are described below:

The mailpieces can fundamentally be detected by any suitable detection, whereby product recognition systems, in particular teachable product recognition systems, are especially well-suited.

In another advantageous embodiment of the invention, in at least some of the unloading stations, the mailpieces are removed from the transportation containers by a robot.

The use of one or more robots for the stackwise removal of the mailpieces further increases the unloading speed.

The term "robot" is to be understood in the broadest sense of the word as a programmable manipulator. In particular, this means a reprogrammable multifunctional manipulator for executing changeably programmable movement sequences as set forth in the definition of the term "robot" according to The Robotics Institute of America.

In an especially preferred embodiment of the invention, mailpieces of at least one of the postal categories are fed to a subsequent processing station by means of a conveyor belt. With this embodiment of the invention, at least some of the mailpieces that have been removed from the transportation containers can be transported quickly to one or more of the processing stations located downstream.

Moreover, it is advantageous to equip the unloading stations in such a way that, below one or more transportation containers, there is a—preferably additionally installed—conveyor belt. Thanks to this conveyor belt, mailpieces that have been removed from the transportation containers can be dropped directly onto this conveyor belt, as a result of which they are automatically carried away. This further increases the processing speed.

In terms of the devices, this is advantageously realized in that the unloading station is configured in such a way that it has a holding device for one or more transportation containers and that two conveyor belts for conveying in different directions are provided below the site where the transportation containers are placed.

In this manner, mailpieces of a first postal category can be removed directly from the transportation containers and dropped directly above the suitable conveyor belt.

This is advantageously achieved in that a removal (i.e. manipulation) arm reaches into the mail container, removes a stack of mailpieces of the same postal category, drops them onto a conveyor belt located in front of and/or below the transportation containers and immediately thereafter reaches into the transportation container again and systematically removes more mailpieces of the same postal category.

Additional conveyor belts as well as additional transportation containers can likewise be used to further transport mailpieces of other postal categories.

Advantageously, different types of further transportation are provided for mailpieces of different postal categories so that the type of further transportation can be adapted to the number of mailpieces of a given postal category.

Thus, for example, when the method is carried out with mailpieces involving the postal categories of standard letters, compact letters, large letters and oversize letters, it is advantageous to convey machine-processable standard letters on one conveyor belt, machine-processable large and oversize letters on another conveyor belt and to drop the mailpieces of other postal categories into other transportation containers.

Furthermore, it is advantageous to carry out at least a partial singulation of the mailpieces on at least one of the conveyor belts.

In an especially preferred embodiment of the invention, the type of singulation is adapted to the postal category in question and to the mailing volume.

Thus, for example, it is advantageous for letters of a frequently occurring postal category—preferably machine-processable standard letters—to be subjected to one or more processing steps that promote their singulation while they are being transported on the conveyor belt.

When the method is carried out with an especially high mailing volume, the singulation steps yield an at least approximately continuous mail flow when the mailpieces are placed onto the conveyor belt essentially in stacks.

Mailpieces present in such a mail flow can be completely singulated in various suitable ways. For example, horizontal-vertical repositioning devices with a down-stream fast-running separation section can be used for this purpose.

In the case of mailpieces located on other conveyor belts—for example, for machine-processable compact and large letters—it is advantageous to carry out a complete singulation on the conveyor belt and to cancel the mailpieces during a pass on the conveyor belt.

An especially advantageous embodiment of such a canceling procedure is referred to below as rolling belt canceling.

In the rolling belt canceling procedure, the large and oversize letters that are to be canceled can be fed on a rolling belt. After being canceled, the oversize letters can then be taken from the belt and placed into prepared containers. An especially advantageous aspect is the possibility to adjust the speed of the rolling canceling belt. The throughput increases due to the simple activity of the rolling canceling (large and oversize) and of the removal of the oversize letters. As a result, the processing speed is increased as compared to manual sorting. Moreover, the mailpiece does not have to be picked up or rotated individually in order to be canceled.

Moreover, it is advantageous to carry out the method in such a way that at least some of the mailpieces are canceled while they are being transported on the conveyor belt.

This embodiment of the invention contributes to a further acceleration of the method. Although carrying out the canceling is fundamentally advantageous for all of the mailpieces that are further transported on conveyer belts, it is especially advantageous to carry out the canceling during the transportation on the conveyor belt for mailpieces with a relatively small mailing volume—for example, for large and oversize letters.

BRIEF DESCRIPTION OF THE DRAWINGS

Additional advantages, special features and practical refinements of the invention can be gleaned from the subordinate claims and from the presentation below of preferred embodiments making reference to the drawings.

DETAILED DESCRIPTION OF PREFERRED EMBODIMENTS

Below, the invention will be described with reference to especially advantageous embodiments.

The described embodiments are especially advantageous since they are suitable for the bulk processing of many mailpieces.

The representation is only to be understood by way of an example and can be used in a plurality of methods for processing mailpieces.

In particular, the described postal categories are only to be understood by way of examples. The selected postal categories can be adapted to the operational requirements in each case. However, it is especially advantageous to use known postal categories since then the method is compatible with other processing steps for mailpieces.

The designations of the postal categories can correspond to the postal categories used by the applicant as well as to other operational requirements of postal centers.

Moreover, the invention can also be realized in a myriad of structural ways.

Figure 1:
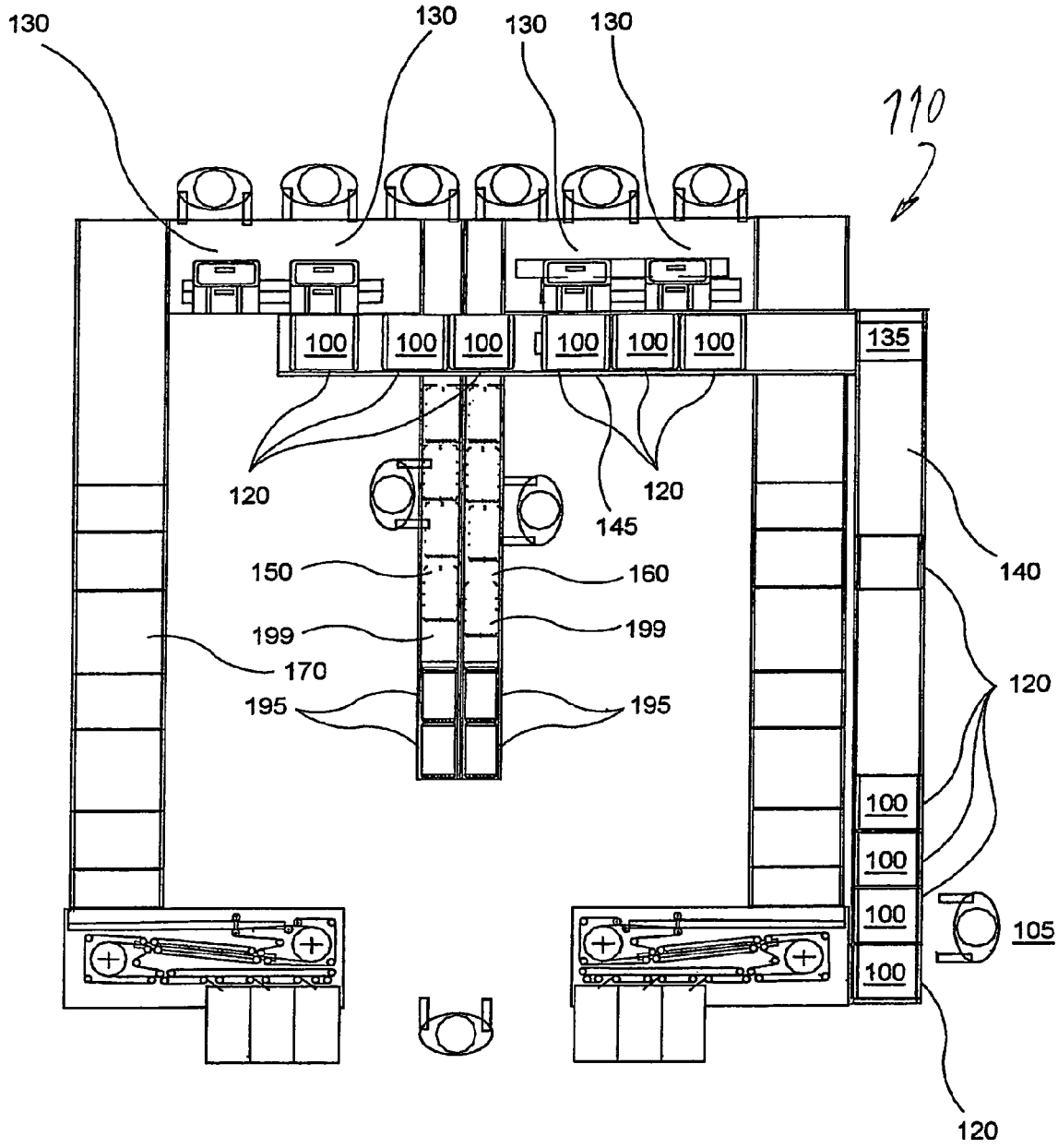
FIG. 1 illustrates a schematic representation of a device that is suitable for carrying out the removal of the mailpieces and their subsequent processing.
Figure 2:
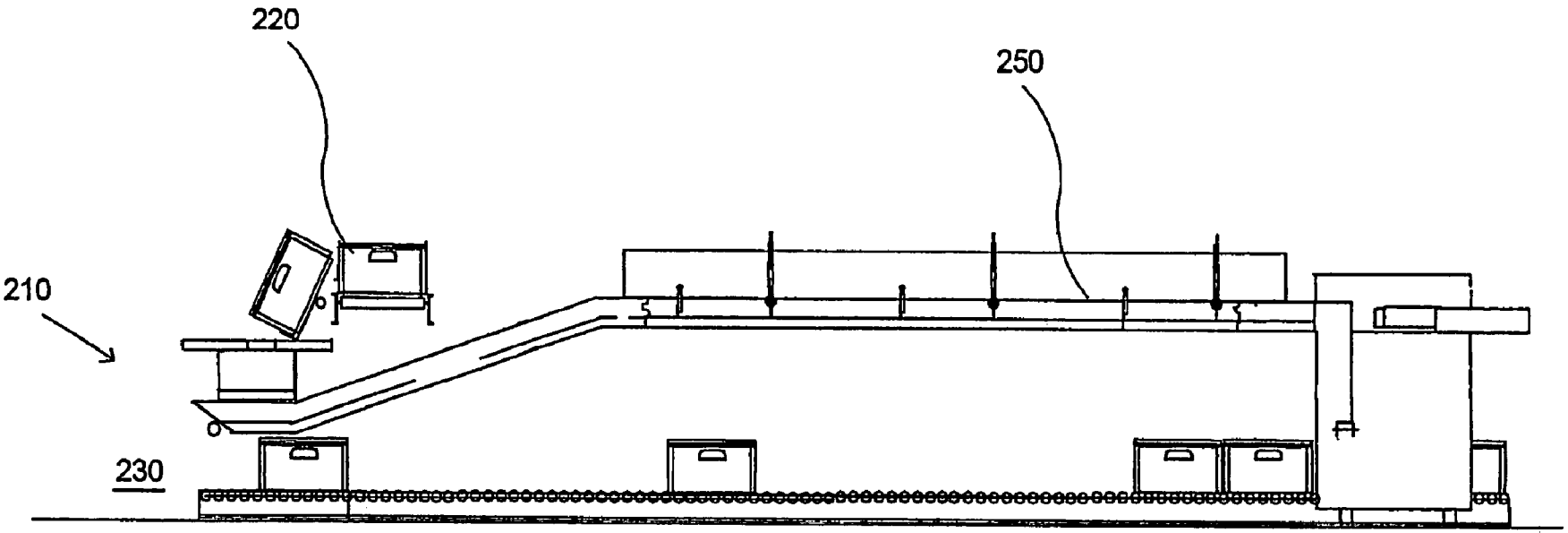
FIG. 2 illustrates a section through the device shown in FIG. 1 along the line A-A.
Figure 3:
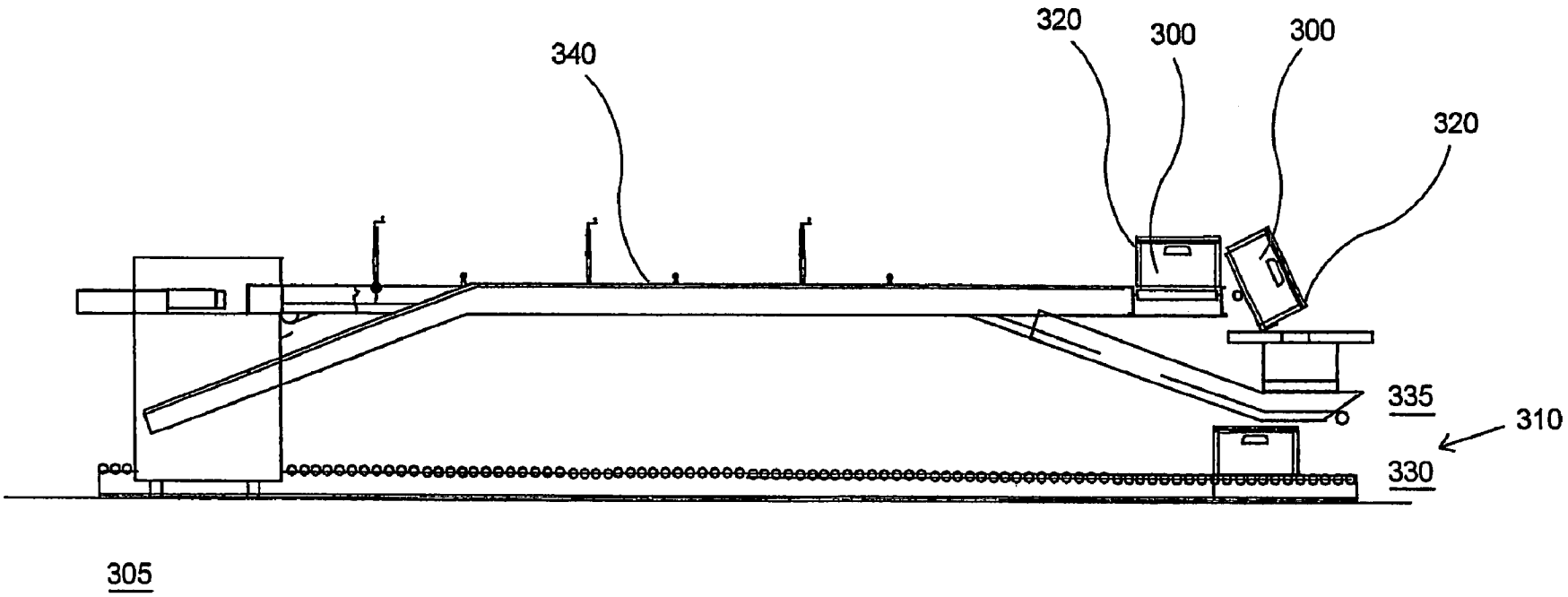
FIG. 3 illustrates a section through the device shown in FIG. 1 along the line B-B.
Figure 4:
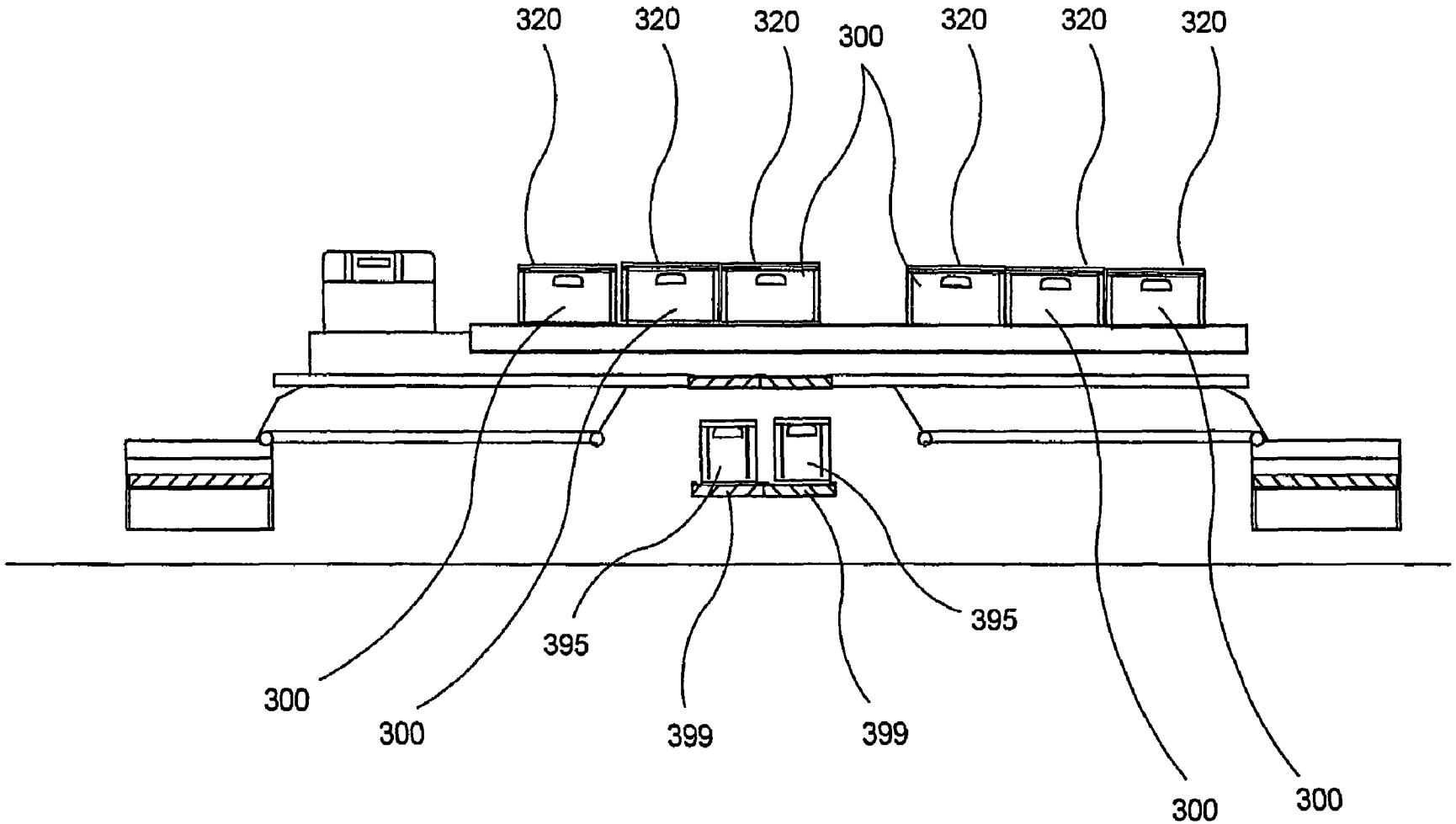
FIG. 4 illustrates a section through the device shown in FIG. 1 along the line C-C.

In particular, the invention does not depend on a specific embodiment of the sorting devices 110, 210, 310 of FIGS. 1-3, separately.

Before the mailpieces are processed in the sorting devices 110, 210, 310, large numbers of mailpieces 100, 200, 300 that have been dropped into mail drop boxes are collected and subsequently transported in transportation containers 120, 220, 320 to postal centers.

Advantageously, the transportation containers are transported in the postal centers directly to the sorting devices 110, 210, 310.

In order to ensure that at least one transportation container 120, 220, 320 filled with mailpieces is present in the sorting devices 110, 210, 310 at each of unloading stations 130, 230, 330 during the processing of the mailpieces, it is advantageous to transport the transportation containers 120, 220, 320 filled with the mailpieces 100, 200, 300 intermittently to the unloading stations 130, 230, 330.

In an especially preferred embodiment, the transportation containers 120, 220, 320 are transported by a conveyor section 140, 340.

The structure of the conveyor section is shown in FIG. 1 as well as in FIG. 3.

Transportation containers 120, 320 filled with mailpieces 100, 300 are placed onto conveyor section 140, 340 in the area of loading stations 105, 305.

The conveyor section 140, 340 contains suitable devices for transporting the transportation containers 120, 320. The devices (not shown here for the sake of clarity) are, for example, a suitably driven conveyer belt or a roller conveyor with driven rollers.

The conveyor section 140, 340 serves to transport the transportation containers 120, 320 to the unloading stations 130, 330.

The transportation containers 120, 320 can be transported to the unloading stations 130, 330 either directly or else via other transportation means.

An integration of additional transportation means allows an adaptation to different physical situations and thus considerable space savings.

Such an especially substantial space savings is achieved in the embodiment shown in FIG. 1 and FIG. 3 in that a repositioning device 135, 335 is located at the end of the conveyor section 140, 340 opposite from the loading station 105, 305.

The repositioning device 135, 335 allows a transfer of the transportation containers 120, 320 to an additional conveyor section 145.

In an especially preferred embodiment, an additional conveyor section 145 extends essentially perpendicularly to the first conveyor section 140.

The embodiment with a first conveyor section 140, 340 and a second conveyor section 145 entails the advantage that the subsequent removal of the mailpieces 100, 300 from the transportation containers 120, 320 is largely uncoupled from the feed of the transportation containers 120, 320.

This advantageous uncoupling is also retained when a repositioning device 135, 335 is located between the first conveyor section 140, 340 and the second conveyor section 145. However, the repositioning device 135, 335 is associated with the additional advantage that the transportation containers 120, 320 can be taken to the unloading stations 130, 330 more quickly and with relatively few structural requirements.

Details of the unloading stations 130, 230, 330 are shown in FIGS. 1, 2, and 3.

In particular, it is advantageous for two transportation containers to be situated next to each other, at least at times, at each of the unloading stations 130, 230, 330.

Advantageously, the transportation containers 120, 220, 320 are taken to the unloading stations 130, 230, 330 in such a way that the transportation containers have an adjustable tilt angle of preferably about 50° to about 70° with respect to the horizontal.

In the area of the unloading stations 130, 230, 330, a suitable product recognition system of the type known, for example, from EP 0 685 814 B1, the disclosure of which is incorporated herein by reference, is used to recognize stacks of mailpieces of the same postal category. Immediately after the recognition of the stack, or especially advantageously, essentially simultaneously with the recognition of the stack of mailpieces of the same postal category, a manipulation arm reaches into the transportation container 120, 220, 320 that is located in the area of the unloading station 130, 230, 330 and removes from the transportation container 120, 220, 320 the previously recognized stack of mailpieces 100, 200, 300 of the same postal category.

The manipulation arm is configured in different ways here. An implementation example is disclosed in EP 0 251 441 B1.

Immediately after the removal of the stack of mailpieces, the manipulation arm drops the stack of mailpieces 100, 200, 300 onto a conveyor belt that, if possible, is in the immediate vicinity of the transportation container.

The conveyor belt conveys standard letters and compact letters to another conveyor belt 170, 175, 250, 280, 350, 380.

Large letters are transported by another conveyor belt located in the area of the unloading stations 130, 230, 330 to another conveyor belt 150, 160 for the conveyance of large letters.

At a mail volume of about 30,000 to 42,000 mailpieces per hour—of which about 30,000 to 36,000 are standard or compact letters and, for the rest, large or oversize letters—for large letters as well as two conveyor belts for standard letters, a singulation already occurs for the large letters through the selection of the conveying speed of the conveyor belts.

An additional singulation is carried out for standard letters and compact letters during the transportation on the conveyor belts 170, 175, 250, 280, 350, 380.

In order to further accelerate the method and to save more space, it is advantageous that an outgoing conveyor section 290, 390 is arranged underneath the conveyor section 140, 340 and/or underneath the conveyor belts 170, 175, 250 in order to return the emptied transportation containers 120, 220, 320.

For purposes of achieving a rapid further transportation of the mailpieces that have been processed in the area of the sorting device 110, 210, 310, it is advantageous to provide a means for automatically feeding additional transportation containers 195, 395.

In an especially preferred embodiment, the feed device for additional transportation containers 195, 395 is configured in such a way that the additional transportation containers 195, 395 are arranged directly underneath the end of conveyor belts 150, 160 that are transporting processed mailpieces.

In an especially advantageous embodiment, the mailpieces slide directly via a chute 198 into the additional transportation container 195.

Although the additional transportation containers 195, 395 can have the same dimensions as the transportation containers 120, 220, 320 for the transport of the unsorted mailpieces, it is especially advantageous to configure the additional transportation containers 195, 395 with smaller dimensions—especially with a smaller footprint.

In an especially preferred embodiment, the additional transportation containers 195, 395 have dimensions that are slightly larger than the maximum size of the mailpieces being transported on the conveyor belts 150, 160.

In this manner, an orientation of the mailpieces that was achieved during the transfer of the mailpieces to the conveyor belts 150, 160 can be retained.

An especially advantageous configuration of the feed means for the additional transportation containers 195, 395 is configured in such a way that, at least over certain sections, the transportation containers 195, 395 are transported parallel to the conveyor belts 150, 160.

In an especially advantageous embodiment, this is done in that, at least over certain sections, the conveying means for the additional transportation containers 195, 395 are located parallel to the conveyor belts 150, 160 for the mailpieces that are to be put into the additional transportation containers 195, 395.

An especially advantageous configuration of this is characterized in that the conveying means is configured as a conveyor section 199, 399.

In an especially preferred embodiment, the conveyor section 199, 399, which preferably extends parallel to the conveyor belts 150, 160 and advantageously in the same direction but at a much lower transportation speed, is arranged directly below a conveyor belt 150, 160.

In this manner, the mailpieces conveyed on the conveyor belt 150, 160 can reach the additional transportation containers 195, 395 directly, for example, via a chute 198.

Such a further transport of the mailpieces into the additional transportation containers 195, 395 calls for very little processing effort and is also very space-saving so as to allow the feeding of the additional transportation containers 195, 395 to be well integrated into the sorting devices.

Moreover, this also reduces the space requirement for the further transport of the additional transportation containers 195, 395 as well as the required storage space for additional transportation containers 195, 395 to be fed.

In the manner presented, the described sorting device can be integrated into existing postal centers.

In the postal centers, standard letters are canceled in automatic canceling machines. Address reading machines read the address and encode the mailpiece. In fine sorting machines, the letter is sorted in terms of the individual deliverer, parcel compartment systems/large customers, and then the mail volume intended for the deliverer is sorted so as to correspond to the delivery sequence (street number by street number) in the delivery sequence sorting machines. The machine throughput rate is, for example, 36,000 mailpieces per hour=10 letters per second.

This throughput rate relates to the number of standard mailpieces processed with the sorting device. Moreover, mail of additional postal categories can be present among the processed mailpieces, but the above-described process steps subject these mailpieces to a different processing operation than the standard letters.

In particular, it is advantageous to subject so-called machine-processable mailpieces to different processing steps than other mailpieces. The machine-processable mailpieces are especially standard letters. In particular, mailpieces that are flexible and that have standard dimensions are processed here. Mailpieces that are stiff or that have inflexible inserts and/or thickened edges on one side, or rounded edges or other deviations from standardized dimensions are fed to special processing means by the depicted sorting devices.

LIST OF REFERENCE NUMERALS

100 mailpieces
105 loading station
110 sorting device
120 transportation container
130 unloading stations
140 conveyor section
145 conveyor section
150 conveyor belt
160 conveyor belt
170 conveyor belt
175 conveyor belt
195 additional transportation container
198 chute
199 conveyor section
200 mailpieces
210 sorting device
220 transportation container

230 unloading stations
250 conveyor belt
290 outgoing conveyor section
300 mailpieces
305 loading station
310 sorting device
320 transportation container
330 unloading stations
340 conveyor section
390 outgoing conveyor section
395 additional transportation container
399 conveyor section

The invention claimed is:

1. A method for processing mailpieces, comprising:

collecting a plurality of mailpieces that have been dropped into mail drop boxes;

transporting the mailpieces in transportation containers to postal centers;

sorting the mailpieces in the postal centers with sorting devices, filling the mailpieces into the transportation containers, transporting the filled transportation containers to unloading stations in the postal centers, carrying out presorting according to postal categories partially and coincidentally during at least one of the filling and transport of the transportation containers to the postal center, removing the mailpieces from the transportation containers at the unloading stations utilizing said presorting, a manipulation arm reaching into a transportation container that is located in the area of the unloading station immediately after a stack of mailpieces of the same postal category has been recognized, the manipulation arm removing from the transportation container the previously recognized stack of mailpieces of the same postal category, the manipulation arm dropping the stack of mailpieces onto a conveyor belt that is located in the area of the unloading station, and conveying the mailpieces to subsequent processing stations as a function of the postal category.

2. The method of claim 1, comprising transporting the mailpieces in essentially box-shaped transportation containers.

3. The method of claim 1, comprising setting up at least some of the transportation containers in drop-off places whom, at least from one side, the malpieces can be dropped off In a way that promotes an essentially horizontal position.

4. The method of claim 1, comprising conveying at least some of the transportation containers in a transporter to mailers of mailpieces so that, in the area of the mailer of mailpieces, the mailpieces can be dropped essentially horizontally into the transportation containers.

5. The method of claim 1, comprising placing at least some of the transportation containers into mailboxes In such a way that mailpieces dropped into the mailboxes end up directly in the transportation containers.

6. The method of claim 1, comprising filing at least some of the transportation containers by emptying collecting containers located in mailboxes.

7. The method of claim 1, comprising taking at least some of the transportation containers directly to the unloading stations.

8. The method of claims 1, comprising taking at least some of the transportation containers to the unloading stations by a conveyor section.

9. The method of claim 1, comprising conveying at least some of the transportation containers to the unloading stations intermittently.

10. The method of claim 1, comprising conveying the transportation containers to the unloading stations in such a way that, at least at times, at least two transportation containers are located in the area of an unloading station.

11. The method of claim 1, comprising removing stacks of mailpieces of different postal categories from the transportation containers, and, subsequently tipping out mailpieces of one postal category remaining in the transportation containers from the transportation containers.

12. The method of claim 1, comprising removing individual mailpieces from the transportation containers by a partial tipping of the transportation containers, and, subsequently tipping out stacks of mailpieces of different postal categories from the transportation containers.

13. The method of claim 1, comprising recognizing stacks of mail-pieces by at least one optical detector means.

14. The method of claim 1, comprising in at least some of the unloading stations removing the mailpieces from the transportation containers by a robot.

15. The method of claim 1, comprising feeding mailpieces of at least one of the postal categories to a subsequent processing station by at least one conveyor belt.

16. The method of claim 15, comprising at least partially singulating the mailpieces while they are being transported on the conveyor belt.

17. The method of claim 15, comprising canceling at least some of the mailpieces while they are being transported on the conveyor belt.

* * * * *